US008685869B2

(12) United States Patent
Byles et al.

(10) Patent No.: US 8,685,869 B2
(45) **Date of Patent: *Apr. 1, 2014**

(54) FLAME-RESISTANT HIGH VISIBILITY TEXTILE FABRIC FOR USE IN SAFETY APPAREL

(75) Inventors: Michael N. Byles, High Point, NC (US); John N. Wasylyk, High Point, NC (US)

(73) Assignee: Innovative Textiles, Inc., High Point, NC (US)

( * ) Notice: Subject to any disclaimer, the term of this patent is extended or adjusted under 35 U.S.C. 154(b) by 576 days.

This patent is subject to a terminal disclaimer.

(21) Appl. No.: 12/459,147

(22) Filed: Jun. 26, 2009

(65) Prior Publication Data

US 2010/0003880 A1 Jan. 7, 2010

Related U.S. Application Data

(63) Continuation-in-part of application No. 11/724,404, filed on Mar. 15, 2007, now Pat. No. 7,553,782.

(51) Int. Cl.

| | |
|---|---|
| ***D04B 1/14*** | (2006.01) |
| ***D04B 1/04*** | (2006.01) |
| ***D04B 21/20*** | (2006.01) |
| ***D04B 9/34*** | (2006.01) |
| ***D04B 7/04*** | (2006.01) |

(52) U.S. Cl.
USPC ..... 442/312; 442/304; 442/310; 442/311; 428/920; 428/921; 66/136; 66/137; 66/196

(58) Field of Classification Search
USPC ..... 442/304–318; 66/136, 137, 196; 57/243, 244, 252; 428/920–921
See application file for complete search history.

(56) References Cited

U.S. PATENT DOCUMENTS

| | | | | |
|---|---|---|---|---|
| 5,965,223 | A * | 10/1999 | Andrews et al. | 428/34.5 |
| 6,706,650 | B2 | 3/2004 | Gibson et al. | 442/167 |
| 6,787,228 | B2 | 9/2004 | Campbell et al. | 428/365 |
| 6,946,412 | B2 | 9/2005 | Campbell et al. | 442/302 |
| 7,473,659 | B2 * | 1/2009 | Sytz | 442/312 |
| 7,678,718 | B2 * | 3/2010 | Harris et al. | 442/310 |
| 2004/0192134 | A1 * | 9/2004 | Gibson et al. | 442/167 |
| 2005/0112975 | A1 * | 5/2005 | McMurray | 442/306 |
| 2006/0068664 | A1 * | 3/2006 | Gibson et al. | 442/197 |
| 2006/0090272 | A1 * | 5/2006 | Mio et al. | 8/531 |
| 2006/0211319 | A1 * | 9/2006 | Masuda et al. | 442/181 |
| 2007/0077839 | A1 * | 4/2007 | McKinnon et al. | 442/312 |
| 2008/0076312 | A1 | 3/2008 | Gehring | 442/306 |
| 2009/0126057 | A1 * | 5/2009 | Rock et al. | 2/2.5 |

OTHER PUBLICATIONS

Knitting Technology, Chapters, 5, 7 and 10, David J. Spencer copyright 1989, 2001, 3rd edition, Woodhead Publishing.*

* cited by examiner

*Primary Examiner* — Jennifer A Steele
(74) *Attorney, Agent, or Firm* — K&L Gates LLP

(57) ABSTRACT

A knitted textile fabric for use in safety apparel, comprising a first yarn containing modacrylic fibers and a second yarn containing apparel, preferably cellulosic, fibers. The first and second yarns are interknitted with one another, e.g., in plated or bi-ply, relationship with the modacrylic yarn disposed predominantly at an outer face of the fabric for imparting flame resistant properties and an affinity for high visibility dyes and with the cellulosic yarn disposed predominantly at the opposite face of the fabric for imparting a hand suitable for comfortable body contact with a user's skin.

19 Claims, 2 Drawing Sheets

FLAME-RESISTANT HIGH VISIBILITY TEXTILE FABRIC FOR USE IN SAFETY APPAREL

CROSS-REFERENCE TO RELATED APPLICATIONS

This is a continuation-in-part of co-pending U.S. patent application Ser. No. 11/724,404, filed Mar. 15, 2007, entitled FLAME-RESISTANT HIGH VISIBILITY TEXTILE FABRIC FOR USE IN SAFETY APPAREL, incorporated herein by reference.

BACKGROUND OF THE INVENTION

The present invention relates generally to textile fabrics suitable for use in safety apparel. More particularly, the present invention relates to such fabrics which are flame resistant and also have an affinity for high visibility dyes meeting established standards for such.

Workers in many occupations are exposed to various personal safety hazards which can be mitigated by wearing safety apparel which provides selected properties such as flame resistance and high visibility. Such safety apparel has wide-spread applications across many varied occupations, such as in particular within the construction and manufacturing industries.

To date, governmental organizations have not promulgated defined minimum standards for such safety apparel. However, private organizations, such as the American National Standards Institute (ANSI), the Safety Equipment Association (ISEA) and the American Society for Testing and Materials (ASTM), have published certain standards for safety apparel. For example, ANSI in conjunction with ISEA has established a standard for the minimum conspicuity of safety apparel used in certain occupational activities so as to be deemed "high visibility", such standard commonly designated as ANSI/ISEA-107. ASTM has similarly developed a standard for minimum flame resistant in safety apparel, designated as standard ASTM F-1506.

Until recently, the textile industry considered such standards to be essentially incompatible as the vast majority of textile fiber materials suitable for apparel fabrication which meet the ASTM F-1506 flame resistant standard are incapable of being dyed to a luminescence sufficient to meet the ANSI/ISEA-107 standard for high visibility and, visa-versa, the vast majority of textile fiber materials suitable for apparel fabrication which have a sufficient affinity for luminescent dyeing to meet the ANSI/ISEA-107 standard would not provide flame resistance properties meeting the ASTM F-1506 standard.

However, it has been discovered that modacrylic fibers have a dye affinity and flame resistance characteristics capable of satisfying both standards and, accordingly, in recent years, textile fabrics have been developed which are composed entirely or predominantly of modacrylic fibers for use in fabricating safety apparel to meet each standard. Representative examples of such fabrics are disclosed in U.S. Pat. Nos. 6,706,650; 6,787,228; and 6,946,412, and U.S. Patent Application Publication No. 20040192134.

While such modacrylic fabrics satisfy the aforementioned flame resistance and high visibility standards, safety apparel made from such fabrics has thus far achieved only limited acceptance within the apparel industry because such fabrics are stiff, abrasive and otherwise very uncomfortable when worn, particularly when in contact with a wearer's skin. Accordingly, there is a recognized and yet unmet need within the relevant safety apparel industry for an alternative fabric providing apparel-like hand and comfort properties while still meeting the relevant flame resistance and high visibility standards.

SUMMARY OF THE INVENTION

It is accordingly an object of the present invention to provide a textile fabric which provides flame resistance and high visibility properties so as to be suitable for use in safety apparel but also provides a comfortable hand suitable for direct contact with a wearer's body.

The present invention addresses this objective by forming a textile fabric of two different types of yarns integrated into the textile fabric such that one yarn or yarns having flame resistance and high visibility properties is disposed predominantly at one face of the fabric forming an outer layer of the fabric while the other yarn or yarns having a hand suitable for comfortable body contact with a user's skin is disposed predominantly at the opposite face of the fabric forming an inner layer of the fabric, whereby the fabric can be fashioned into safety apparel with the first-mentioned face disposed outwardly for flame resistance and high visibility protection and with the other face disposed inwardly towards the wearer's body to promote comfort by buffering the user's skin from the outer face of the fabric.

While many varied embodiments of the fabric utilizing differing yarns and differing fabric constructions are contemplated to be possible, it is considered advantageous that the first yarn or yarns comprise a sufficient content of modacrylic fibers to provide the outer face of the fabric with the requisite flame resistance and affinity for high visibility dyeing so as to substantially meet the currently established standards, ANSI/ISEA-107 and ASTM F-1506, and the other yarn or yarns should have a sufficient content of conventional apparel-suitable fibers, e.g., cotton, other cellulosic (including rayon), animal hair, silk, polyester, polyamide, acrylic, and polyimide fibers, so as to provide a comfortable hand to the inner face of the fabric.

For example, but without limitation, it is contemplated that the first yarn appearing at the one outer face of the fabric may preferably have a content of modacrylic fibers ranging between twenty percent (20%) and one hundred percent (100%), while the second yarn appearing predominantly at the opposite inner face of the fabric may preferably have an apparel fiber content of at least about fifty percent (50%) and may also optionally include modacrylic fibers. It is preferred that the first yarn at the outer face of the fabric be predominantly of modacrylic fibers, i.e., fifty percent (50%) or greater, and more preferably, the outer face yarn preferably has approximately seventy percent (70%) or greater modacrylic fiber content. In one particular embodiment of the present fabric, the one outer face yarn comprises approximately ninety percent (90%) modacrylic fibers and approximately ten percent (10%) polyester fibers, while the other inner face yarn comprises approximately fifty percent (50%) cotton fibers and approximately fifty percent (50%) modacrylic fibers.

The fabric may be formed of any suitable construction by which the first yarns offering flame resistance and high visibility properties are disposed predominantly at the one outer face of the fabric and the second yarns offering comfort properties are disposed predominantly at the opposite inner face of the fabric. One particularly embodiment contemplated by the present invention is a knitted fabric wherein the two yarns are formed in plated relationship interknitted in a common stitch pattern, e.g., by circular knitting, presenting the first yarn disposed predominantly at an outer face of the fabric forming an outer layer of the fabric and the second yarn disposed predominantly at an inner face of the fabric forming an inner layer of the fabric integrally intermeshed with the outer layer.

Another contemplated alternative embodiment of the fabric is a knitted fabric of a bi-ply construction comprised of an outer ply predominantly at one face of said fabric which is flame resistant and has an affinity for high visibility dyes and an inner ply predominantly at the opposite face of said fabric of a hand suitable for comfortable body contact with a user's skin. The outer ply is knitted of a first yarn comprising predominantly a flame resistant modacrylic material and the inner ply is knitted of a second yarn comprising predominantly apparel fibers without inherent or additive flame resistant characteristics, the fabric plys connected with one another in a bi-ply relationship by spaced apart stitches of one of the yarns interknitted with the other of the yarns for integrating said outer and inner plys.

While such a plated and bi-ply knit fabric constructions are presently preferred, the present invention also contemplates various other textile fabric construction methodologies such as a plated warp knitted fabric construction, a so-called spacer-type warp knitted fabric construction, a two-ply woven fabric construction or an alternative woven fabric construction of a pattern presenting warp and weft yarns predominantly at opposite faces of the fabric, such as a twill fabric construction.

Other features, characteristics and advantages of the present invention are described more fully hereinafter.

DETAILED DESCRIPTION OF THE PREFERRED EMBODIMENTS

Figure 1:
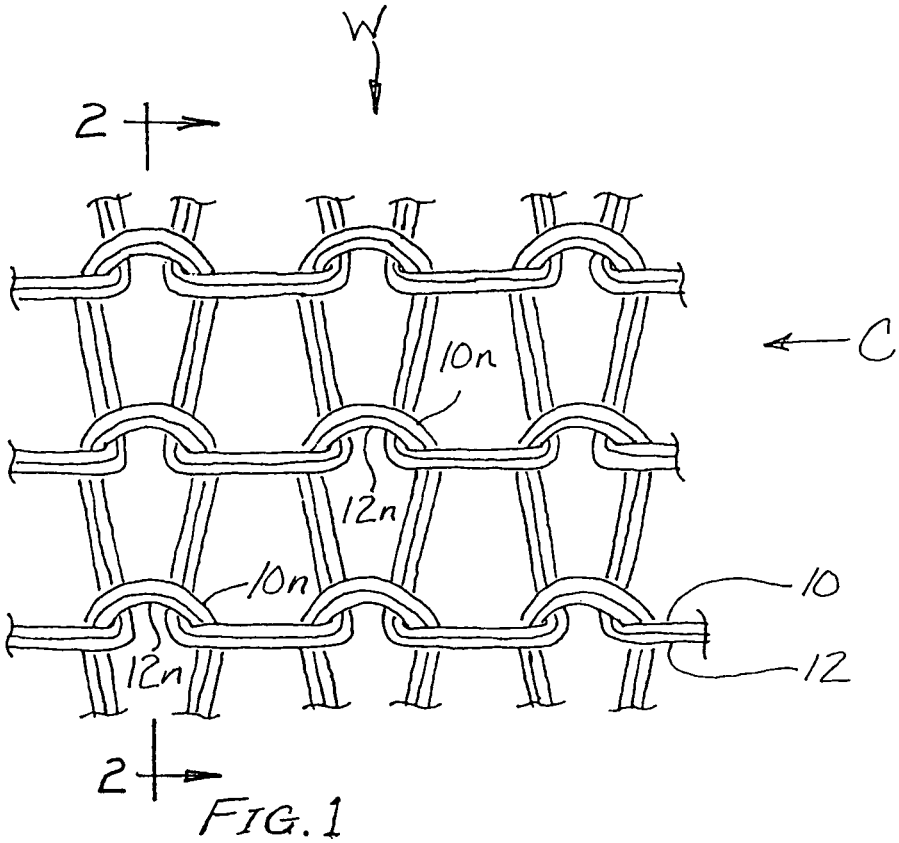
FIG. 1 depicts diagrammatically in elevation the knitted structure of a textile fabric according to one preferred embodiment of the present invention.
Figure 2:
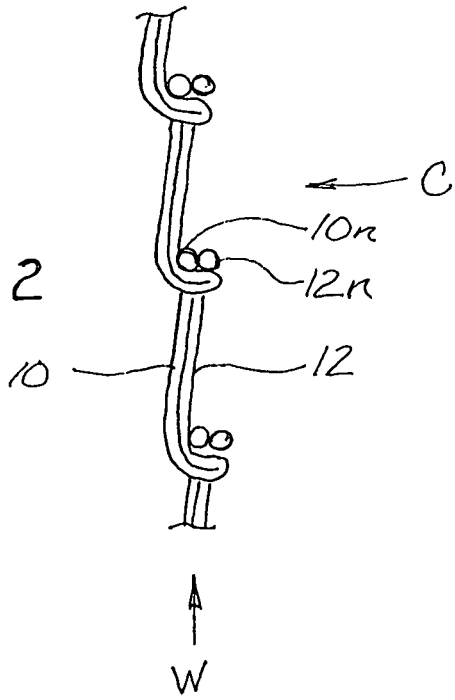
FIG. 2 depicts diagrammatically in cross-section the knitted structure of the textile fabric of FIG. 1, as viewed along section line 2-2 thereof.

Referring now initially to the accompanying drawings of FIGS. 1 and 2, a fragmentary portion of a textile fabric according to the present invention is shown at 10 in one representative embodiment fabricated by circular knitting on a circular knitting machine which may be of any suitable type the fabrication and construction of which is commonly known within the industry and therefore need not be fully described herein.

Such knitting machines basically include a rotatable needle cylinder with axial needle slots formed at a spacing from one another about the outer circumferential surface of the cylinder. A plurality of knitting needles, typically latch-type needles each having a yarn receiving hook and a closeable latch assembly, are reciprocably disposed within the axial cylinder slots. Stationary needle-actuating cams are positioned outwardly about and adjacent to the needle cylinder. Typically, the knitting machine has multiple knitting stations at which yarn feeding fingers or other feeding instruments are positioned for yarn feeding disposition adjacent the upper end of the needle cylinder to feed yarn to the needles thereat.

For the knitting of the fabric 10 according to the present invention, the knitting machine is set up at each knitting station to deliver simultaneously two yarns 12, 14, described more fully hereinafter, to each needle via the yarn feeding instruments. As the needle cylinder rotates during operation, the needles are operatively manipulated within the respective slots of the cylinder by the adjacent stationary cams to receive and stitch the yarns 12, 14 identically in a common stitch pattern into interknitted loops extending in circumferential courses and axial wales. The knitting of the fabric 10 proceeds in this fashion for a predetermined number of successive revolutions of the knitting machine sufficient to progressively knit the yarns 12, 14 into a continuous seamless length of tubular fabric 10 of a desired length. The simultaneous delivery of both yarns 12, 14 to each needle at each knitting station thusly forms the yarns in plated relationship in a single jersey stitch construction throughout the entirety of the fabric 10.

As will thus be understood, the resultant knitted structure of the fabric 10 is shown schematically in an enlarged form in the drawings of FIGS. 1 and 2. As indicated, each yarn 12, 14 is formed identically in plated needle loops 12*n*, 14*n* extending circumferentially about the fabric 10 in courses C and aligned lengthwise along the fabric 10 in perpendicular wales W. In the drawing of FIG. 1, the plated relationship of the yarns 12, 14 is depicted diagrammatically and schematically by showing the yarns side by side in the same plane, but those persons skilled in the art will recognize and understand that, within the three dimensional structure of the actual fabric 10, the yarns 12, 14 are actually formed in overlying relationship with the yarn 12 disposed predominantly at one face of the fabric 10 while the yarn 14 is disposed predominantly at the opposite face of the fabric 10, as shown in the cross-sectional view of FIG. 2.

In accordance with the present invention, the yarns 12, 14 incorporated into the fabrication of the textile fabric 10 are selected to achieve differing physical and chemical properties in the fabric 10 at the opposite faces of the fabric. Specifically, the yarn 12 appearing at one face of the fabric is selected to have a sufficiently high content of a flame resistant material to impart to such face of the fabric flame resistance properties which will comply with prevailing flame resistance standards observed within the textile industry, particularly standard ASTM F-1506 established by the American Society for Testing and Materials. By contrast, the yarn 14 appearing at the opposite face of the fabric is a material of the type ordinarily utilized in apparel fabric to impart to such face of the fabric 10 a satisfactory hand, e.g., non-abrasive, flexible and not stiff, and essentially soft, to be suitable for direct body contact with the skin of a person wearing safety apparel. In this manner, the fabric 10 can be fabricated into safety garments with the face of the fabric predominantly comprised of the yarn 12 as outward face of the garment and with the opposite face of the fabric predominantly comprised of the yarn 14 as the inner face of the garment.

Various yarns are deemed to be suitable for these purposes. Specifically, the yarn 12 can be selected from any fibrous material exhibiting satisfactory flame resistance or fire retardant properties. The yarns presently considered most preferable for use in safety apparel applications of the fabric 10 are yarns having a modacrylic fiber content, because modacrylic fibers are known to exhibit flame resistant properties and also to have an affinity to receive dyes which will provide high fluorescence and optimally will meet established standards for minimum high visibility conspicuity, such as standard ANSI/ISEA-107 established by the American National Standard Institute. The yarn 14 appearing at the inner face of the fabric 10 may be selected from any known apparel fiber, whether natural or synthetic in origin, which will typically not have any inherent nor additive flame retardant characteristics, and including by way of example but without limitation cotton, other natural cellulosic fibers such as flax, animal hair (wool, alpaca, cashmere, etc.), silk, polyester, polyamide (nylons), acrylic, synthetic cellulosic fibers such as rayon, and polyimide fibers. Cotton is considered to have the most widespread potential application in the yarn 14, as it is widely available, relatively inexpensive, and is well established to provide a soft comfortable hand pleasing to the vast majority of apparel wearers.

Importantly, the yarn 12 does not necessarily have to be formed entirely of a flame resistant fiber such as modacrylic, nor does the yarn 14 necessarily need to be formed entirely of an apparel fiber. For example, for safety apparel applications intended to meet both flame resistance and high visibility standards, it is only necessary that the total content of the fabric, including both yarns 12 and 14, offers sufficient flame resistance to meet such criteria and that the yarn 12 have a sufficient content of fiber having an affinity for high visibility dyes so as to meet such standards. As will be understood, greater flexibility in the selection of yarns and the yarn content will be available in fabrics intended for safety apparel that is not necessarily to be used in applications requiring high visibility dyeing. By way of example, but without limitation, in fabrics wherein modacrylic fibers are utilized to impart the requisite flame resistance properties, the yarn 12 may have a modacrylic content as low as approximately twenty percent (20%) up to as high as one hundred percent (100%). Preferably, the yarn 12 has a modacrylic content of at least fifty percent (50%) to be predominantly modacrylic, and most preferably of a seventy percent (70%) or greater modacrylic content. The yarn 14 may have an apparel fiber content from one hundred percent (100%) down to as low as approximately fifty percent (50%) with the other fiber content being modacrylic or an alternative fiber, including another flame resistant fiber. One particularly suitable embodiment of the present fabric 10 is fabricated of a blended staple fiber spun yarn as the yarn 12 comprised of approximately ninety percent (90%) modacrylic fibers and approximately ten percent (10%) polyester fibers (which may be a flame resistant polyester), and blended staple fiber spun yarn as the yarn 14 comprised of approximately fifty percent (50%) cotton and approximately fifty percent (50%) modacrylic fibers.

Advantageously, the present invention accordingly provides a fabric 10 having one face which will offer both a high level of flame resistance capable of meeting the ASTM F-1506 standard and also having an affinity for dyeing by high visibility fluorescent dyes capable of meeting the ANSI/ISEA-107 standard, while the yarn 12 which impart these properties are separated from the body of a wearer by the yarn 14 predominantly forming inner face of the fabric 10 which by contrast impart a hand comparable to normal apparel and avoiding the stiffness and abrasiveness of modacrylic fibers. As such, the fabric 10 of the present invention overcomes the disadvantages of known safety apparel fabrics and is expected to achieve a much wider acceptance and use in the safety apparel industry.

Figure 4:
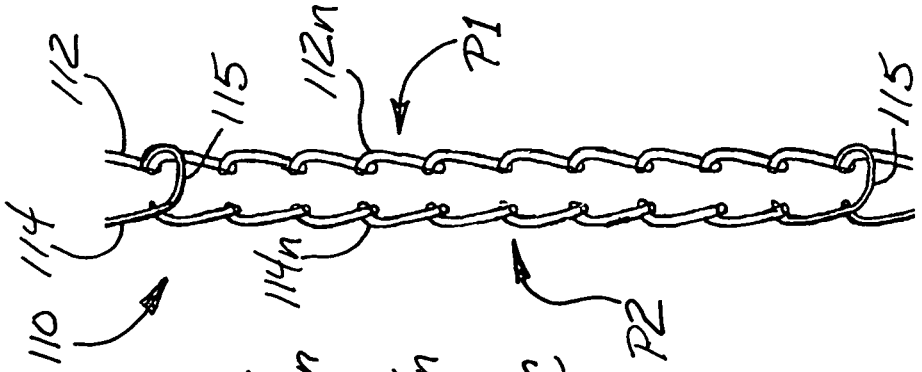
FIG. 4 depicts diagrammatically in cross-section the knitted structure of the textile fabric of FIG. 3, as viewed along section line 4-4 thereof.
Figure 3:
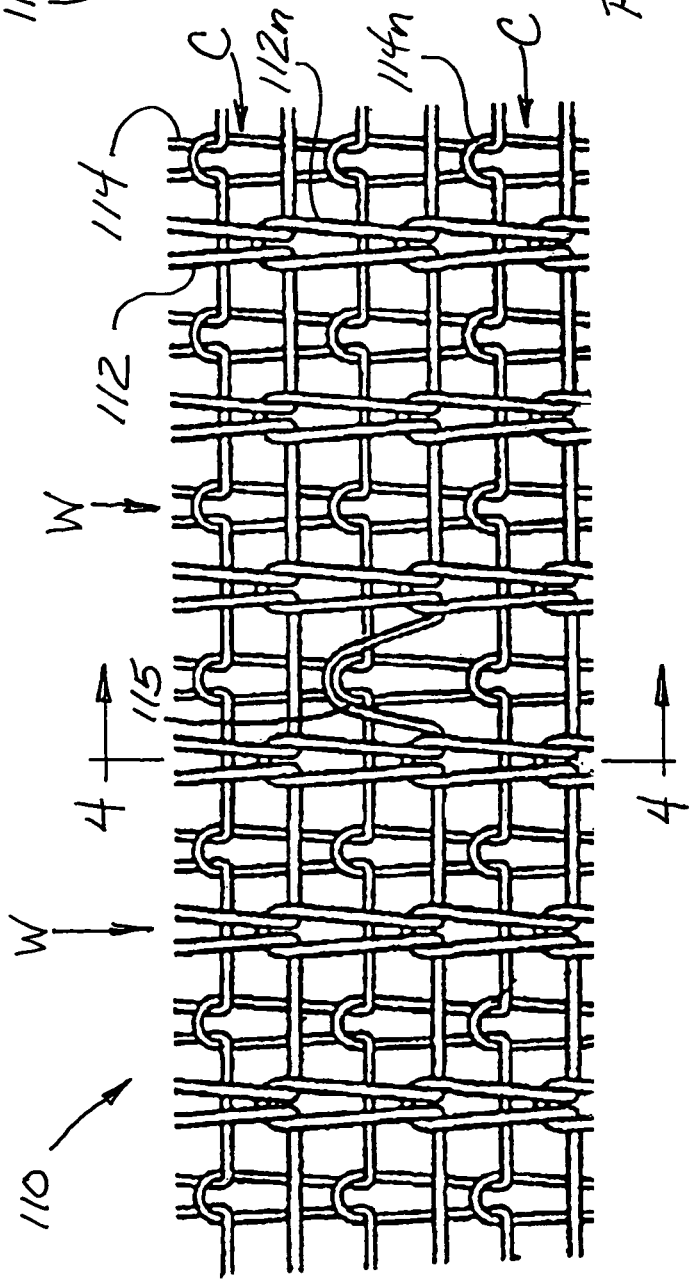
FIG. 3 depicts diagrammatically in elevation the knitted structure of a textile, fabric according to another preferred embodiment of the present invention.

Turning to FIGS. 3 and 4, a fragmentary portion of a textile fabric according to another representative embodiment the present invention is shown at 110. The fabric 110 is also fabricated by circular knitting on a double knit type of circular knitting machine in a form of fabric structure commonly referred to as bi-ply wherein respective first and second yarns 112, 114 are formed as respective knitted plys connected with one another at spaced apart interknitted stitches 115. The fabrication, construction and operation of such double knit circular knitting machines is commonly known within the industry and therefore need not be fully described herein. Such knitting machines basically include two cooperating sets of knitting needles disposed in confronting cooperating circular arrangements, e.g., in a rotatable needle cylinder with axial needle slots and a radially oriented needle dial with radial needle slots supporting respective pluralities of latch-type or other knitting needles for respective reciprocable movements relative to the other set of needles. Typically, the knitting machine has multiple knitting stations associated with each circle of needles at which yarn feeding fingers or other feeding instruments deliver yarns to the respective sets of needles.

For the knitting of the fabric 110 according to the present invention, the knitting machine is set up to deliver, via the yarn feeding instruments, one yarn 112 to be knitted by one set of needles and the other yarn 114 to be knitted by the other set of needles. The two sets of needles stitch the yarns 112, 114 into two respective circularly knitted fabric webs or plys P1, P2, each having the respective yarns 112, 114 formed into knitted loops 112*n*, 114*n* extending within the respective web in circumferential courses C and axial wales W. As the knitting of the fabric 10 proceeds in this fashion over successive revolutions of the knitting machine, selected spaced needles (e.g., every twelve needles) in one of the two sets of needles are manipulated periodically to transfer the yarn 112 to corresponding needles of the other set of needles to form the stitches 115 as tuck stitches connecting the two plys P1, P2 together at desired intervals among the axial wales W of the fabric. Depending on the number of yarn feeds provided on the knitting machine, the tucking manipulation of the selected needles may occur at one or more feeds during every revolution of the knitting machine or at a less frequent interval, e.g., every other revolution, as necessary also to space the tuck stitches at desired intervals among the circumferential courses C of the fabric, e.g., every twelve courses. In FIG. 3, only one such tuck stitch 115 is shown, and in FIG. 4, only two such tuck stitches 115 are shown, for illustrative purposes, but it will be understood by persons skilled in the art that the connecting tuck stitches 115 are selectively formed at desired walewise and coursewise spacings throughout the fabric 110.

As in the embodiment of FIGS. 1 and 2, the yarns 112, 114 incorporated into the fabrication of the textile fabric 110 are different yarns selected to achieve differing physical and chemical properties in the fabric 110 at the opposite faces of the fabric formed by the respective fabric plys P1, P2, according to the same criteria as the yarns 12, 14. Thus, the yarn 112 of the ply P1 preferably has a sufficiently high content of a flame resistant material, such as modacrylic fibers, to provide flame resistance properties and dyeability with high visibility dyes. The yarn 114 of the ply P2 preferably includes apparel fibers, such as cotton, to impart to such face of the fabric 10 a non-abrasive, flexible and essentially soft hand to be suitable for direct body contact with a wearer. As with the fabric 10, the fabric 110 can be fabricated into safety garments with the outer layer of the fabric formed by the ply P1 comprised of the yarn 112 as the outward face of the garment and with the opposite layer of the fabric formed by the ply P2 comprised of the yarn 114 as the inner face of the garment.

The fabric 110 offers substantially all of the same advantages as discussed above for the fabric 10 of FIGS. 1 and 2. In addition, the bi-ply construction of the fabric 110 is expected to provide the further advantage of imparting to the fabric an improved arc rating, i.e., resistance to convective and radiant energy generated by momentary electric arcs to which workers may be exposed, as compared to other safety apparel fabric. Conventionally, arc resistant fabrics are typically relatively thick and heavy, e.g., made of a laminated, quilted or other multi-layer construction, which compromises comfort in order to achieve a desire arc resistance. Owing to the slight spacing created by the confronting webs or plys of the present fabric 110, as depicted schematically, in FIG. 4, the fabric 110 is expected to provide arc resistance comparable to these known fabrics while the fabric 110 will be of a substantially lesser thickness and lighter weight, enabling safety garments made from the fabric 110 to be much more comfortable while providing an equally functional arc rating.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. A textile fabric for use in safety apparel comprising a first yarn comprised of approximately 55% to 100% of a flame resistant modacrylic fiber and a second yarn comprised of at least 50% to 100% of apparel fibers without inherent or additive flame resistant properties selected from the group consisting of natural or synthetic cellulosic, animal hair, polyester, polyamide, and polyimide fibers, the first and second yarns being interknitted with one another in a plated relationship such that the first yarn is disposed predominantly at an outer face of the fabric forming an outer layer of the fabric having flame resistant properties and an affinity for high visibility dyes and such that the second yarn is disposed predominantly at the opposite inner face of the fabric forming an inner layer of the fabric having a hand suitable for comfortable body contact with a user's skin.

2. A textile fabric for use in safety apparel according to claim 1, wherein the first and second yarns are circularly knitted.

3. A textile fabric for use in safety apparel according to claim 1, wherein the fabric when dyed with a high visibility dye substantially meets American National Standard Institute standard ANSI/ISEA-107 for minimum high-visibility conspicuity of safety apparel used in occupational activities.

4. A textile fabric for use in safety apparel according to claim 1, wherein the fabric substantially meets American Society for Testing and Materials standard ASTM F-1506 for flame resistance.

5. A textile fabric for use in safety apparel according to claim 1, wherein the first yarn comprises at least 70% modacrylic fibers.

6. A textile fabric for use in safety apparel according to claim 1, wherein the first yarn comprises approximately 90% modacrylic fibers.

7. A textile fabric for use in safety apparel according to claim 1, wherein the first yarn further comprises polyester fibers.

8. A textile fabric for use in safety apparel according to claim 1, wherein the apparel fibers comprise at least one of cotton and rayon fibers.

9. A textile fabric for use in safety apparel according to claim 1, wherein the second yarn further comprises modacrylic fibers.

10. A textile fabric for use in safety apparel according to claim 1, wherein the first yarn comprises approximately 90% modacrylic fibers and approximately 10% polyester fibers and the second yarn comprises approximately 50% cotton fibers and approximately 50% modacrylic fibers.

11. A textile fabric for use in safety apparel comprising a first yarn comprised of approximately 55% to 100% of a flame resistant modacrylic fiber and a second yarn comprised of at least 50% to 100% of apparel fibers without inherent or additive flame resistant properties selected from the group consisting of natural or synthetic cellulosic, animal hair, polyester, polyamide, and polyimide fibers, the first and second yarns being knitted in a bi-ply knitted structure wherein the first yarn is knitted as a mostly self-contained first knitted ply, the second yarn is knitted as a mostly self-contained second knitted ply, and the first and second knitted plys are connected with one another only by interknitted stitches of the first and second yarns at multiple discrete locations spaced apart widthwise and lengthwise over the fabric, such that the first yarn is disposed predominantly at an outer face of the fabric forming an outer layer of the fabric having flame resistant properties and an affinity for high visibility dyes and such that the second yarn is disposed predominantly at the opposite inner face of the fabric forming an inner layer of the fabric having a hand suitable for comfortable body contact with a user's skin.

12. A textile fabric for use in safety apparel according to claim 11, wherein the fabric when dyed with a high visibility dye substantially meets American National Standard Institute standard ANSI/ISEA-107 for minimum high-visibility conspicuity of safety apparel used in occupational activities.

13. A textile fabric for use in safety apparel according to claim 11, wherein the fabric substantially meets American Society for Testing and Materials standard ASTM F-1506 for flame resistance.

14. A textile fabric for use in safety apparel according to claim 11, wherein the first yarn comprises at least 70% modacrylic fibers.

15. A textile fabric for use in safety apparel according to claim 11, wherein the first yarn comprises approximately 90% modacrylic fibers.

16. A textile fabric for use in safety apparel according to claim 11, wherein the first yarn further comprises polyester fibers.

17. A textile fabric for use in safety apparel according to claim 11, wherein the cellulosic apparel fibers comprise at least one of cotton and rayon fibers.

18. A textile fabric for use in safety apparel according to claim 11, wherein the second yarn further comprises modacrylic fibers.

19. A textile fabric for use in safety apparel according to claim 11, wherein the first yarn comprises approximately 90% modacrylic fibers and approximately 10% polyester fibers and the second yarn comprises approximately 50% cotton fibers and approximately 50% modacrylic fibers.

* * * * *